US011183797B2

(12) United States Patent
Mandel et al.

(10) Patent No.: US 11,183,797 B2
(45) Date of Patent: Nov. 23, 2021

(54) PLUG CONNECTOR SYSTEM

(71) Applicant: TE Connectivity Germany GmbH, Bensheim (DE)

(72) Inventors: Christian Mandel, Darmstadt (DE); Bert Bergner, Rimbach (DE); Christian Rusch, Schifferstadt (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 16/886,124

(22) Filed: May 28, 2020

(65) Prior Publication Data

US 2020/0381870 A1 Dec. 3, 2020

(30) Foreign Application Priority Data

May 31, 2019 (DE) ..... 102019114646.1

(51) Int. Cl.
*H01R 13/6593* (2011.01)
*H01R 13/6583* (2011.01)
*H01R 13/6592* (2011.01)

(52) U.S. Cl.
CPC ..... *H01R 13/6583* (2013.01); *H01R 13/6592* (2013.01)

(58) Field of Classification Search
CPC ..... H01R 13/6583; H01R 13/6592
USPC ..... 439/607.41
See application file for complete search history.

(56) References Cited

U.S. PATENT DOCUMENTS 2,502,302 A * 3/1950 Arson ..... H01R 24/20 439/732
5,147,221 A 9/1992 Cull et al.
5,176,533 A * 1/1993 Sakurai ..... H01R 13/6277 439/350
5,611,707 A * 3/1997 Meynier ..... H01R 13/6277 439/353
5,879,177 A 3/1999 Honma
6,093,043 A * 7/2000 Gray ..... H01R 13/6277 439/352
6,663,397 B1 * 12/2003 Lin ..... H01R 13/6277 439/154

(Continued)

FOREIGN PATENT DOCUMENTS

DE 102004002402 B3 11/2005
DE 202012008961 U1 12/2012

(Continued)

OTHER PUBLICATIONS

German Office Action, App No. 102019114646.1, dated Feb. 11, 2020, 10 pages.

(Continued)

*Primary Examiner* — Peter G Leigh
(74) *Attorney, Agent, or Firm* — Barley Snyder

(57) ABSTRACT

A plug connector system includes a first plug connector having a shielding sleeve and a second plug connector having a shielding bushing with a plurality of spring elements. The shielding sleeve has an at least partially circumferential bead on an outer side of the shielding sleeve. The shielding sleeve is partially received in the shielding bushing and the at least partially circumferential bead contacts the spring elements when the first plug connector is connected to the second plug connector.

19 Claims, 6 Drawing Sheets

(56) References Cited

U.S. PATENT DOCUMENTS

| | | | | |
|---|---|---|---|---|
| 6,692,286 | B1 * | 2/2004 | De Cet | H01R 13/6277 439/350 |
| 7,481,673 | B1 * | 1/2009 | Qu | H01R 13/5219 439/578 |
| 7,553,185 | B1 * | 6/2009 | Qu | H01R 13/5219 439/578 |
| 7,611,378 | B1 * | 11/2009 | Brekosky | H01R 13/5202 439/500 |
| 8,496,495 | B2 * | 7/2013 | Kari | H01R 13/6277 439/352 |
| 9,281,598 | B2 | 3/2016 | Zebhauser et al. | |
| 9,425,548 | B2 * | 8/2016 | Swearingen | H01R 24/44 |
| 10,224,659 | B2 | 3/2019 | Pemwieser et al. | |
| 10,553,977 | B2 | 2/2020 | Pemwieser et al. | |
| 2004/0110417 | A1 * | 6/2004 | Lin | H01R 13/6271 439/578 |
| 2010/0304598 | A1 | 12/2010 | Kari | |
| 2011/0207360 | A1 | 8/2011 | Jordan | |

FOREIGN PATENT DOCUMENTS

| | | | |
|---|---|---|---|
| EP | 1094565 | A1 | 4/2001 |
| WO | 2017144069 | A1 | 8/2017 |
| WO | 2017144072 | A1 | 8/2017 |

OTHER PUBLICATIONS

Abstract of FR2865319, dated Nov. 3, 2005, 2 pages.
Communication—The extended European search report in Application No. 20177029.4-1201, dated Oct. 1, 2020, 11pp.

* cited by examiner

PLUG CONNECTOR SYSTEM

CROSS-REFERENCE TO RELATED APPLICATION

This application claims the benefit of the filing date under 35 U.S.C. § 119(a)-(d) of German Patent Application No. 102019114646.1, filed on May 31, 2019.

FIELD OF THE INVENTION

The present invention relates to a connector system and, more particularly, to a plug connector system.

BACKGROUND

Plug connector systems with a shielding housing are known in the prior art. Plug connectors of such plug connector systems have shields, which are electrically conductively connected to one another when the plug connectors are connected.

In the case of a variant of such plug connector systems, one of the plug connectors has a shielding bushing with spring elements. The other plug connector has a shielding sleeve, which can be pushed into the shielding bushing of the plug connector counterpart. In this case, the shielding sleeve is electrically contacted by contact beads arranged at the tips of the spring elements of the shielding bushing. This known design, however, has the disadvantage that a part of the shielding sleeve protruding beyond the contact region forms a spur line arranged in the interior of the shield, the length of which spur line is dependent on the plug-in depth of the shielding sleeve. This can result in disadvantageous electrical properties, for example, disadvantageous high-frequency properties.

SUMMARY

A plug connector system includes a first plug connector having a shielding sleeve and a second plug connector having a shielding bushing with a plurality of spring elements. The shielding sleeve has an at least partially circumferential bead on an outer side of the shielding sleeve. The shielding sleeve is partially received in the shielding bushing and the at least partially circumferential bead contacts the spring elements when the first plug connector is connected to the second plug connector.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
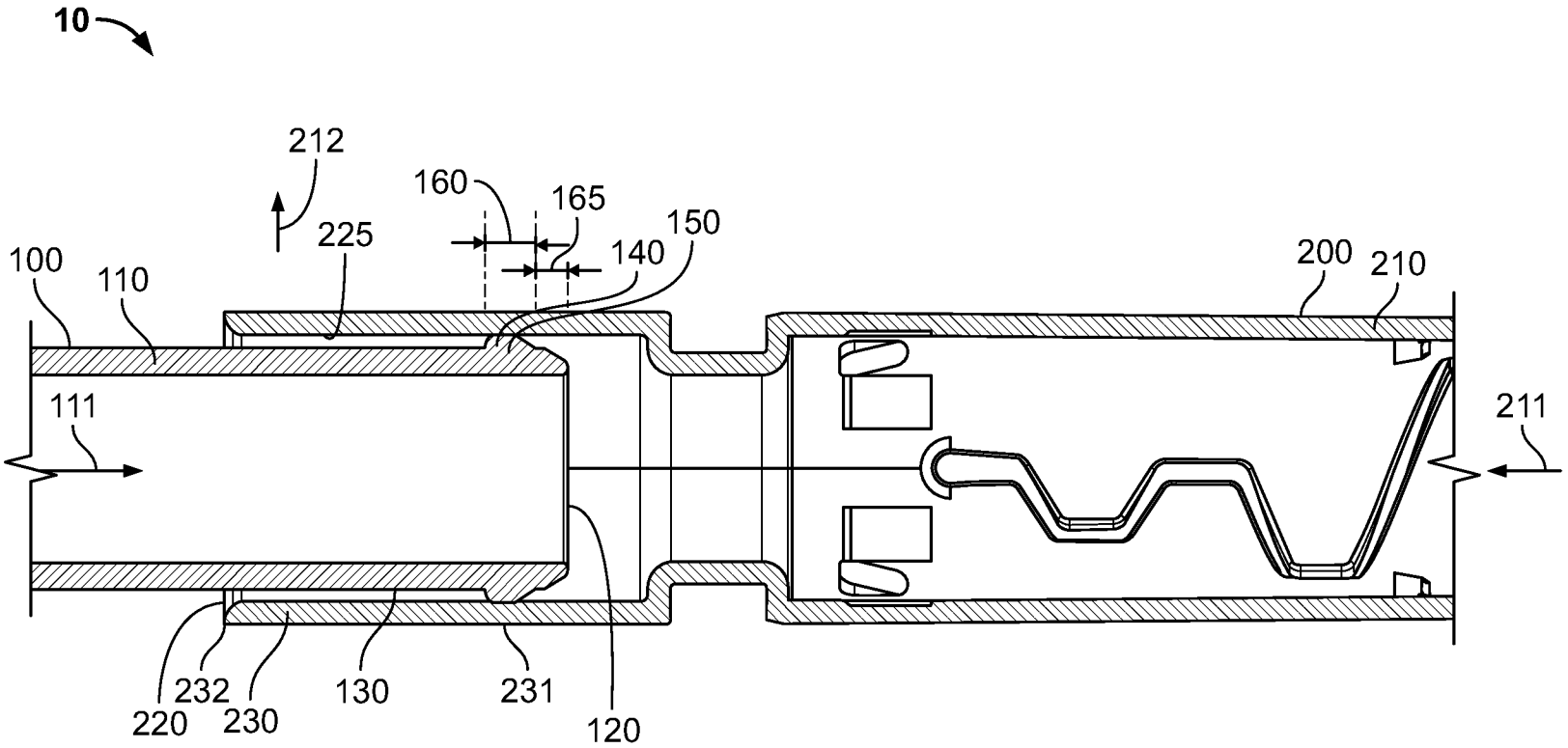
FIG. 1 is a sectional side view of a plug connector system having a first plug connector with a shielding sleeve and a second plug connector with a shielding bushing.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein. Rather, these embodiments are provided so that the present disclosure will convey the concept of the invention to those skilled in the art. The described embodiments are only possible configurations in which, however, the individual features as described below can be provided independently of one another or can be omitted.

A plug connector system 10 according to an embodiment, as shown in FIG. 1, comprises a first plug connector 100 and a second plug connector 200. For the sake of clarity, only parts of the first plug connector 100 and of the second plug connector 200 are depicted in FIG. 1. The depiction is limited substantially to a shielding housing of the plug connector system 10, which guarantees shielding. The plug connector system 10 can be envisaged for transmitting high-frequency signals, for example.

Figure 2:
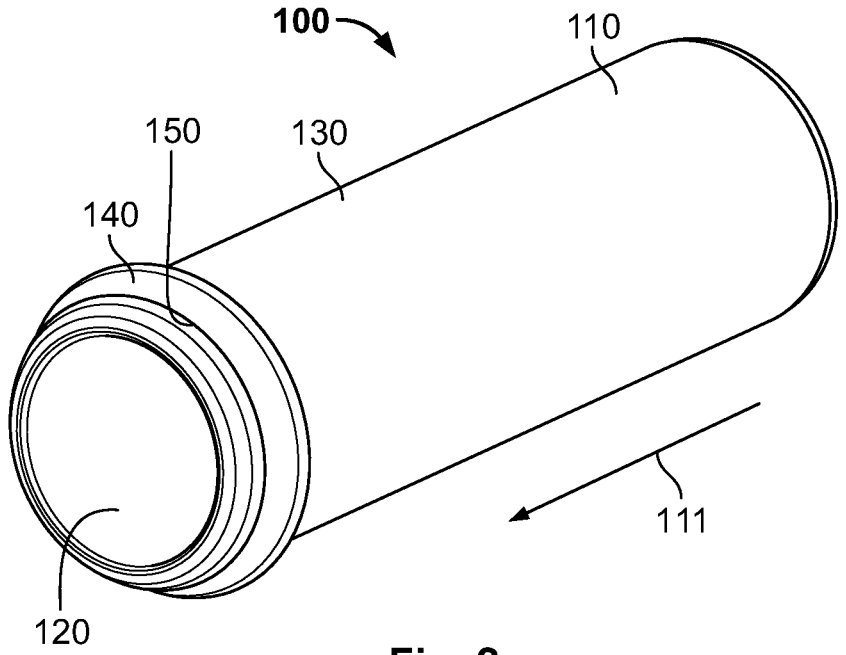
FIG. 2 is a perspective view of the shielding sleeve of the first plug connector.

The first plug connector 100 of the plug connector system 10 has a shielding sleeve 110, as shown in FIGS. 1 and 2. FIG. 1 shows only a part of the shielding sleeve 110. FIG. 2 shows a perspective view of part of the shielding sleeve 110 of the first plug connector 100.

The shielding sleeve 110 has the basic shape of a hollow-cylindrical tube, which extends along a longitudinal direction 111 of the shielding sleeve 110. The shielding sleeve 110 can in this case have a circular cross-section, for example, as shown in FIG. 2. Alternatively, the shielding sleeve 110 can also have an elliptical cross-section, a rectangular cross-section or another cross-section. At a longitudinal end 120 of the shielding sleeve 110, it is open. The shielding sleeve 110 has an electrically conductive material, for example a metal.

As shown in FIGS. 1 and 2, an outer lateral surface of the tubular shielding sleeve 110 forms an outer side 130 of the shielding sleeve 110. On this outer side 130, the shielding sleeve 110 has a circumferential bead 140. The bead 140 is formed as a thickened portion, which rises above the other sections of the outer side 130 of the shielding sleeve 110. In this case, the bead 140 extends in an annular manner around the outer side 130 and is orientated perpendicularly to the longitudinal direction 111 of the shielding sleeve 110. The bead 140 forms a contact region of the shielding sleeve 110. The bead 140 can enclose the outer side 130 in a closed, annular manner. Alternatively, the bead 140 can have one or a plurality of breaks in the circumferential direction, such that the bead 140 is formed only partially circumferentially.

In an embodiment, the bead 140 is arranged as close as possible to the longitudinal end 120 of the shielding sleeve 110. In the example shown in FIGS. 1 and 2, the bead 140 has a width 160 measured in the longitudinal direction 111 at a base 150 of the bead 140. In this case, the base 150 of the bead 140 is defined as the region of the bead 140 at which it merges into the other outer side 130 of the shielding sleeve 110. Furthermore, the bead 140 in the example shown in FIGS. 1 and 2 has a spacing 165 from the longitudinal end 120 of the shielding sleeve 110, measured in the longitudinal direction 111 between the base 150 of the bead 140 and the longitudinal end 120 of the shielding sleeve 110. In an embodiment, the spacing 165 is adapted to a maximum frequency of high-frequency signals transmitted by the plug connector system 10 in such a way that the spacing 165 is less than a fifth of a wavelength conducted at the maximum frequency in the plug connector system 10 or even less than a tenth of this wavelength. The maximum frequency of the high-frequency signals transmitted by the plug connector system 10 in this case can be the highest frequency which can be transmitted in a monomodal manner in the plug connector system 10.

Figure 3:
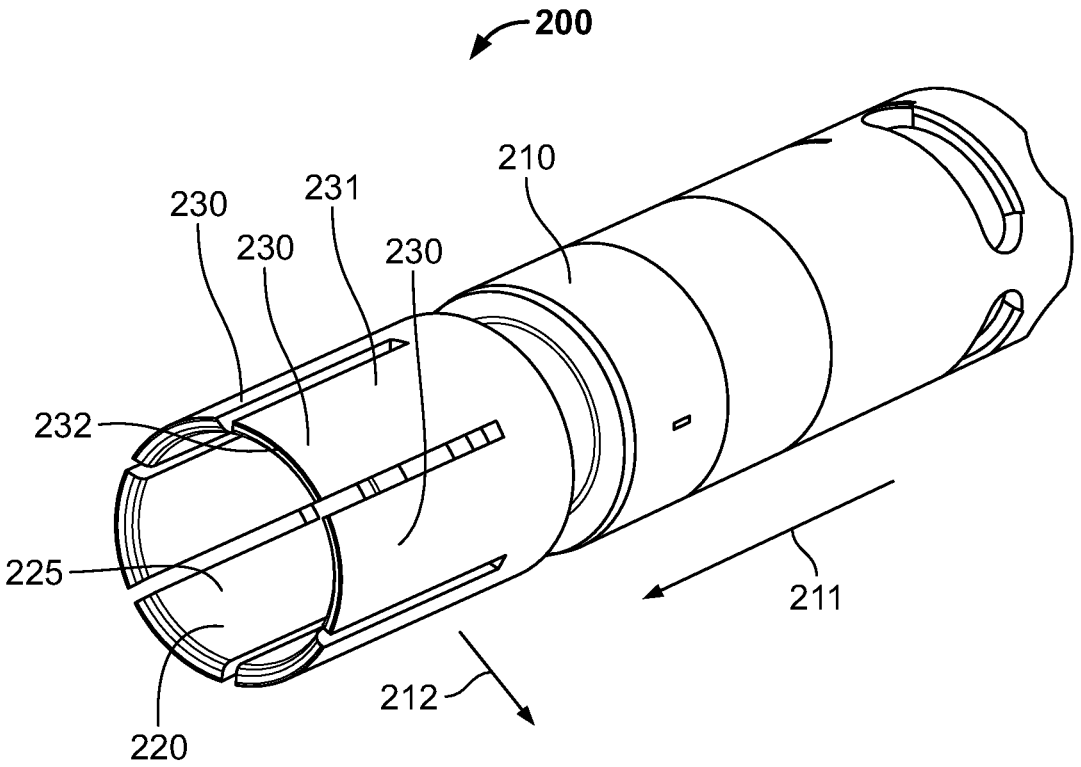
FIG. 3 is a perspective view of the shielding bushing of the second plug connector.

The second plug connector 200 of the plug connector system 10 has a shielding bushing 210, shown in FIGS. 1 and 3. The shielding bushing 210 has the basic form of a hollow-cylindrical tube, which extends along a longitudinal direction 211 of the shielding bushing 210. A longitudinal end of the hollow-cylindrical tube forms an open end 220 of the shielding bushing 210. The shielding bushing 210 has a cross-section matching the shielding sleeve 110, therefore a circular cross-section, for example, as depicted in FIG. 3.

In FIG. 1, it can be seen that the shielding bushing 210 of the second plug connector 200 has a somewhat larger diameter than the shielding sleeve 110 of the first plug connector 100. As a result, the shielding sleeve 110 of the first plug connector 100 can be received at least partially in the shielding bushing 210 of the second plug connector 200. If the first plug connector 100 and the second plug connector 200 of the plug connector system 10 are connected to one another by the first plug connector 100 and the second plug connector 200 being plugged together, the shielding sleeve 110 of the first plug connector 100 is partially plugged into the shielding bushing 210 of the second plug connector 200. In this case, the longitudinal end 120 of the shielding sleeve 110 penetrates into the open end 220 of the shielding bushing 210.

The shielding bushing 210 of the second plug connector 200 has a plurality of spring elements 230, as shown in FIGS. 1 and 3. The spring elements 230 are arranged at the open end 220 of the shielding bushing 210. The spring elements 230 are formed as beams, which are oriented along the longitudinal direction 211 of the shielding bushing 210. In this case, each spring element 230 of the shielding bushing 210 has a first longitudinal end 231 and a second longitudinal end 232. The first longitudinal ends 231 of the spring elements 230 face away from the open end 220 of the shielding bushing 210. The second longitudinal ends 232 of the spring elements 230 face the open end 220 of the shielding bushing 210. At their first longitudinal ends 231, the spring elements 230 are connected to the other sections of the shielding bushing 210. As a result, each spring element 230 is clamped at its first longitudinal end 231. The second longitudinal ends 232 of the spring elements 230 are not connected to one another or to other sections of the shielding bushing 210, and are free as a result.

If the shielding sleeve 110 of the first plug connector 100 is pushed into the shielding bushing 210 of the second plug connector 200 during the connection of the first plug connector 100 to the second plug connector 200, the bead 140 arranged on the outer side 130 of the shielding sleeve 110 comes into contact with an inner side 225 of the shielding bushing 210 in the region of the spring elements 230 of the shielding bushing 210, as shown in FIG. 1. As a result, an electrically conductive connection is produced between the shielding sleeve 110 of the first plug connector 100 and the shielding bushing 210 of the second plug connector 200. In an embodiment, transmission of high-frequency signals in the plug connector system 10 is made possible by the shielding sleeve 110 and the shielding bushing 210.

The spring elements 230 of the shielding bushing 210 of the second plug connector 200 can be deflected in a radial direction 212 of the shielding bushing 210, shown in FIGS. 1 and 2. The outer diameter of the bead 140 of the shielding sleeve 110 of the first plug connector 100 and the inner diameter of the shielding bushing 210 of the second plug connector 200 are adapted to one another in such a way that the spring elements 230 are deflected resiliently in the radial direction 212 of the shielding bushing 210 during the plugging of the shielding sleeve 110 into the shielding bushing 210. As a result, reliable contact between the spring elements 230 of the shielding bushing 210 and the bead 140 of the shielding sleeve 110 can be guaranteed.

In an embodiment, the spring force exerted by the spring elements 230 of the shielding bushing 210 on the bead 140 of the shielding sleeve 110 does not change significantly with the plug-in depth of the shielding sleeve 110 into the shielding bushing 210. In this case, the force exerted by the spring elements 230 of the shielding bushing 210 on the bead 140 of the shielding sleeve 110 during the plugging into the shielding bushing 210 remains substantially the same at all positions of the shielding sleeve 110 in the shielding bushing 210. The spring force exerted by the spring elements 230 of the shielding bushing 210 on the bead 140 of the shielding sleeve 110 can also be referred to as the contact force.

A contact force which is substantially independent of the plug-in depth can, for example, be achieved in that the spring elements 230 of the shielding bushing 210 are formed with a shape which deviates from a simple beam shape. For example, the spring elements 230 can be profiled on the inner side 225 of the shielding bushing 210 in such a way that the deflection of the spring elements 230 in the radial direction 212 during the plugging of the shielding sleeve 110 into the shielding bushing 210 remains substantially constant or within a range for all plug-in depths. Another possibility consists in forming the spring elements 230 with a thickness or width which is variable along its longitudinal direction, in order to achieve a return force of the spring elements 230 which is substantially independent of the plug-in depth.

FIGS. 4-7 illustrate a further possible design of the second plug connector 200, by means of which a contact force, which is substantially independent of the plug-in depth of the shielding sleeve 110 into the shielding bushing 210, can be achieved between the spring elements 230 of the shielding bushing 210 and the bead 140 of the shielding sleeve 110. A part of the shielding sleeve 110 of the first plug connector 100 and a spring element 230 of the shielding bushing 210 of the second plug connector 200 are depicted in each case.

As shown in FIGS. 4-7, the second plug connector 200 has, moreover, an only partially depicted outer housing 300. The shielding bushing 210 is arranged in the outer housing 300. The outer housing 300 has an inner side 310 facing the shielding bushing 210. A projection 320 is arranged on the inner side 310 of the outer housing 300, but this can also be omitted.

Figure 4:
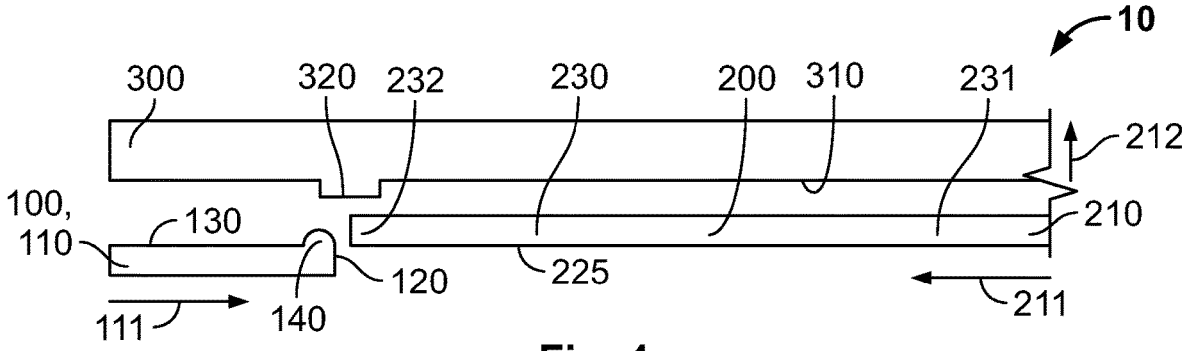
FIG. 4 is a sectional side view of a portion of the plug connector system in a first state of plugging together the first plug connector and the second plug connector.
Figure 5:
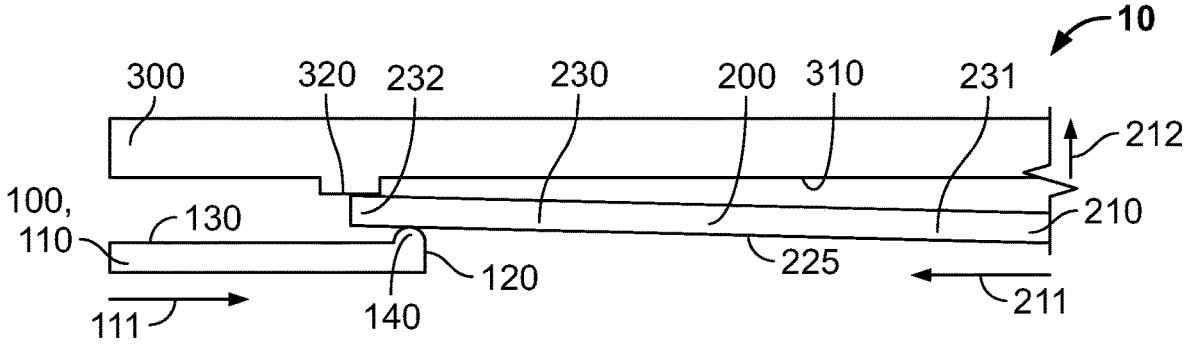
FIG. 5 is a sectional side view of the portion of the plug connector system in a second state of plugging together the first plug connector and the second plug connector.
Figure 6:
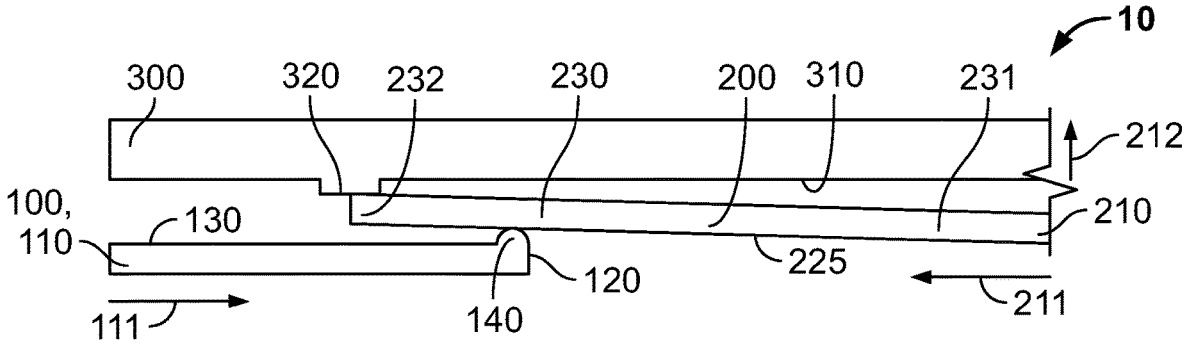
FIG. 6 is a sectional side view of the portion of the plug connector system in a third state of plugging together the first plug connector and the second plug connector.
Figure 7:
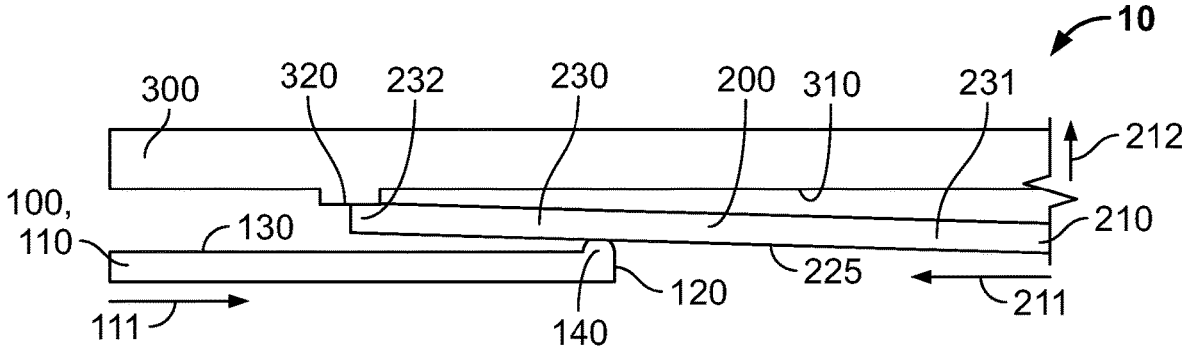
FIG. 7 is a sectional side view of the portion of the plug connector system in an end position and a completely plugged-together state of the first plug connector and the second plug connector.

FIGS. 4-7 illustrate the procedure of the plugging-together of the first plug connector 100 and the second plug connector 200 in such a way that the plug-in depth of the shielding sleeve 110 of the first plug connector 100 into the shielding bushing 210 of the second plug connector 200 increases incrementally from the depiction in FIG. 4 to the depiction in FIG. 7. In the depiction in FIG. 4, the shielding sleeve 110 has not yet penetrated into the shielding bushing 210 at all. The arrangement shown in FIG. 7 can correspond to an end position and thus to a completely plugged-together state of the first plug connector 100 and the second plug connector 200.

In FIGS. 5, 6 and 7, it can be seen that the bead 140 of the shielding sleeve 110 of the first plug connector 100 deflects the spring elements 230 of the shielding bushing 210 of the second plug connector 200 in the radial direction 212 of the second plug connector 200. In this case, the second longitudinal ends 232 of the spring elements 230 come to bear against the projection 320 arranged on the inner side 310 of the outer housing 300. If the projection 320 were not present, the second longitudinal ends 232 of the spring elements 230 would come to bear directly against the inner side 310 of the outer housing 300.

As a result of the bearing of the second longitudinal ends 232 of the spring elements 230 of the shielding bushing 210 against the inner side 310 of the outer housing 300, it is achieved that the second longitudinal ends 232 of the spring elements 230 cannot be deflected further in the radial direction 212 of the shielding bushing 210. As a result, the spring elements 230 are deformed in accordance with a three-point deformation as the plug-in depth of the shielding sleeve 110 into the shielding bushing 210 increases further. As a result, it is achieved that the contact force exerted by the spring elements 230 of the shielding bushing 210 on the bead 140 of the shielding sleeve 110 remains substantially constant with the further increasing plug-in depth.

Figure 8:
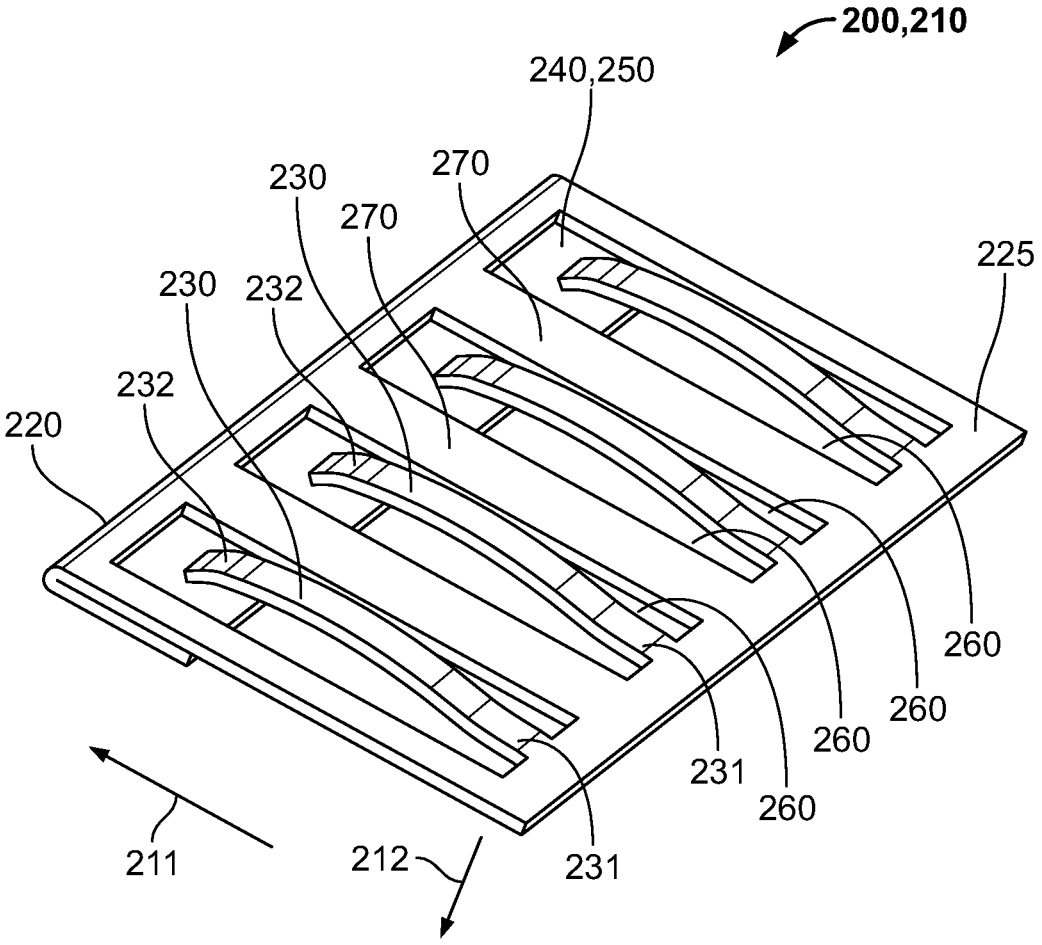
FIG. 8 is a perspective view of a shielding bushing of the second plug connector according to another embodiment.

FIG. 8 shows a diagrammatic depiction of a further possible design of the shielding bushing 210 of the second plug connector 200 of the plug connector system 10. For ease of depiction, FIG. 8 shows the shielding bushing 210 in an unwound state, in which the lateral surface of the cylindrical basic shape of the shielding bushing 210 is unwound to form a flat plate. In reality, the shielding bushing 210 is bent around an axis parallel to the longitudinal direction 211 to form a hollow-cylindrical shape.

Also in the variant of the shielding bushing 210 shown in FIG. 8, the spring elements 230 are clamped at their first longitudinal ends 231 and are free at their second longitudinal ends 232. The spring elements 230 in this case are separated from the other sections of the shielding bushing 210 by slots 260. In the variant of the shielding bushing 210 shown in FIG. 8, in contrast to the variant of the shielding bushing 210 shown in FIGS. 1 and 3, a web 270 is arranged between adjacent spring elements 230 in each case. As a result, the variant of the shielding bushing 210 shown in FIG. 8 can have a great torsional rigidity.

A further difference of the variant of the shielding bushing 210 shown in FIG. 8 from the variant of the shielding bushing 210 shown in FIGS. 1 and 3 is that the spring elements 230 in the variant of the shielding bushing 210 shown in FIG. 8 in the unstressed state are bent in such a way that middle sections of the spring elements 230 arranged between the first longitudinal ends 231 and the second longitudinal ends 232 protrude into the interior of the shielding bushing 210. The variant of the shielding bushing 210 shown in FIG. 8 moreover has an outwardly bent-over section 240 at its open end 220. This outwardly bent-over section 240 can, for example, form a retainer 250, which facilitates the insertion of the shielding sleeve 110 of the first plug connector 100 into the shielding bushing 210 of the second plug connector 200.

The spring elements 230 of the variant of the shielding bushing 210 shown in FIG. 8 are bent in such a way that the second longitudinal ends 232 of the spring elements 230 bear against the bent-over section 240. As a result, it is achieved that the second longitudinal ends 232 of the spring elements 230 cannot be deflected further in the radial direction 212 of the shielding bushing 210 during the pushing of the shielding sleeve 110 of the first plug connector 100 into the shielding bushing 210. As a result, also in the case of the variant of the shielding bushing 210 shown in FIG. 8, it is achieved that the spring elements 230 are deformed in accordance with a three-point deformation during the plugging of the shielding sleeve 110 into the shielding bushing 210. This can make it possible for the contact force exerted by the spring elements 230 of the shielding bushing 210 on the bead 140 of the shielding sleeve 110 to be largely independent of the plug-in depth of the shielding sleeve 110 in the shielding bushing 210.

Figure 9:
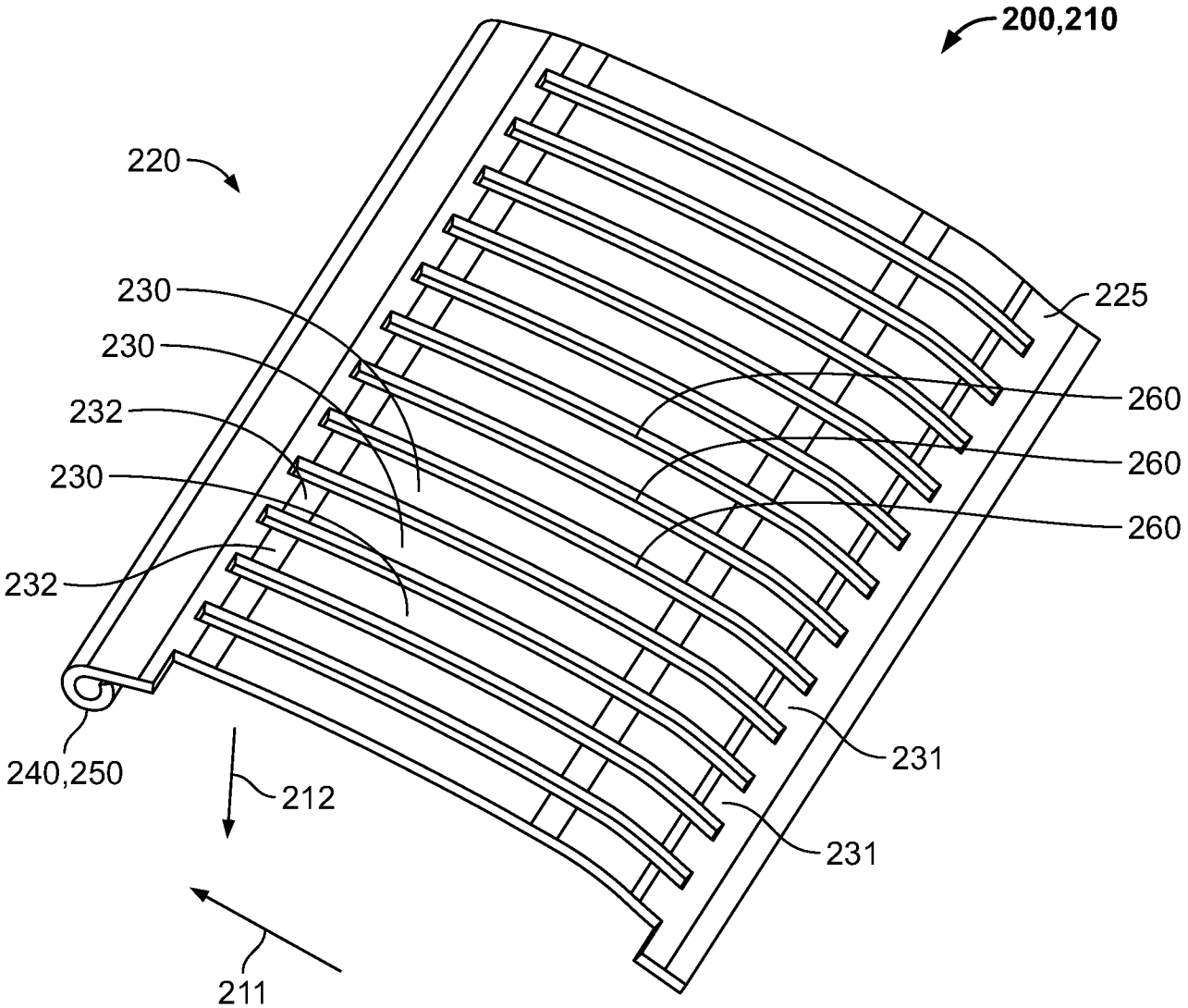
FIG. 9 is a perspective view of a shielding bushing of the second plug connector according to another embodiment.

FIG. 9 shows a diagrammatic depiction of a further variant of the shielding bushing 210 of the second plug connector 200. Similarly to the depiction in FIG. 8, for ease of depiction the shielding bushing 210 in FIG. 9 is shown in unwound form.

The variant of the shielding bushing 210 shown in FIG. 9 differs from the variants of the shielding bushing 210 shown in FIGS. 1, 3 and 8 in that the second longitudinal ends 232 of the spring elements 230 are not free, but rather are clamped. The second longitudinal ends 232 of the spring elements 230 are therefore, like the first longitudinal ends 231, connected to one another and to the other sections of the shielding bushing 210 in a materially uniform and cohesive manner. The spring elements 230 are separated from one another by slots 260 only between their first longitudinal ends 231 and their second longitudinal ends 232.

In the case of the variant of the shielding bushing 210 shown in FIG. 9, the spring elements 230 in the unstressed state are bent in such a way that middle sections of the spring elements 230 arranged between the first longitudinal ends 231 and the second longitudinal ends 232 protrude into the space enclosed by the shielding bushing 210. In the case of the variant of the shielding bushing 210 shown in FIG. 9, no webs are formed between the spring elements 230. However, it is possible to form the variant of the shielding bushing 210 shown in FIG. 9 with webs which are arranged between the spring elements 230 and which are not bent. The variant without webs arranged between the spring elements 230, shown in FIG. 9, affords the advantage that a large contact region is formed between the spring elements 230 of the shielding bushing 210 and the bead 140 of the shielding sleeve 110.

The variant of the shielding bushing 210 shown in FIG. 9 also has an outwardly bent-over section 240 at its open end 220. This can in turn serve to facilitate the insertion of the shielding sleeve 110 of the first plug connector 100 into the shielding bushing 210 of the second plug connector 200.

Figure 11:
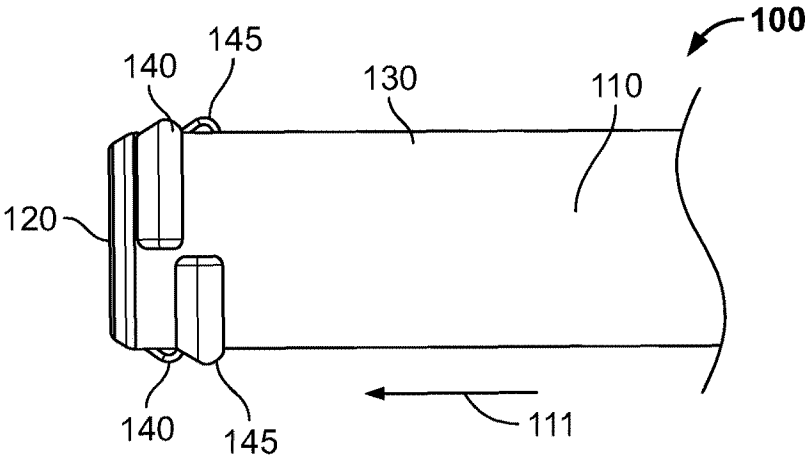
FIG. 11 is a side view of the shielding sleeve of FIG. 10.
Figure 10:
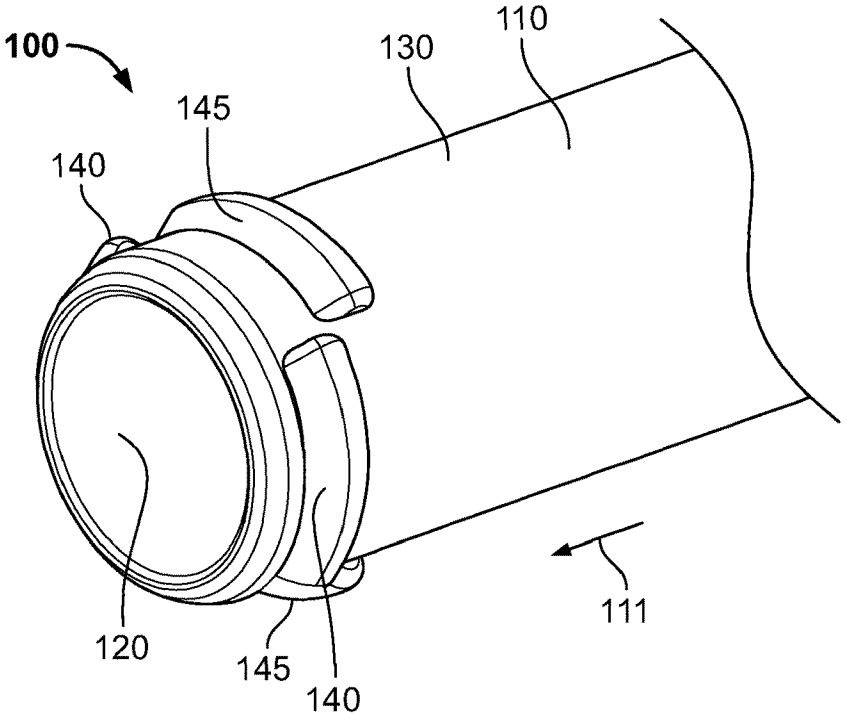
FIG. 10 is a perspective view of the shielding sleeve of the first plug connector according to another embodiment.

FIGS. 10 and 11 show a schematic depiction of a further possible design of the shielding sleeve 110 of the first plug connector 100 of the plug connector system 10. In this case, FIG. 10 shows a perspective view, while FIG. 11 shows a side view.

The variant of the shielding sleeve 110 shown in FIGS. 10 and 11 differs from the variant of the shielding sleeve 110 shown in FIGS. 1 and 2 in that the bead 140 in the variant of the shielding sleeve 110 shown in FIGS. 10 and 11 is not formed in a closed, circumferential manner. Instead, the bead 140 extends circumferentially only partially over the outer side 130 of the shielding sleeve 110. In the example shown in FIGS. 10 and 11, the bead 140 comprises two sections, which encompass an angle of 90° in each case and which are spaced apart from one another by gaps of 90° in each case. The bead 140 can, however, also be subdivided into a different number of sections, which run partially around the outer side 130 of the shielding sleeve 110 in a different way.

In addition to the bead 140, the shielding sleeve 110 has a further bead 145 in the variant shown in FIGS. 10 and 11. The further bead 145 likewise extends partially circumferentially around the outer side 130 of the shielding sleeve 110. The further bead 145 is oriented parallel to the bead 140 and perpendicularly to the longitudinal direction 111 of the shielding sleeve 110. In this case, the further bead 145 is offset from the bead 140 in the longitudinal direction 111 of the shielding sleeve 110 in such a way that the further bead 145 is spaced further apart from the longitudinal end 120 of the shielding sleeve 110 than the bead 140.

In the depicted example, the sections of the further bead 145 are formed to be complementary to the sections of the bead 140, in such a way that the individual sections of the further bead 145, in the circumferential direction of the shielding sleeve 110, cover precisely those angular ranges in which the bead 140 has gaps, and vice versa. Accordingly, in the example shown in FIGS. 10 and 11, the further bead 145 likewise has two sections, which encompass an angle of 90° in each case and which are spaced apart from one another by gaps of 90° in each case. However, it is also possible to form the further bead 145 with a different number of sections and with differently dimensioned sections, which run partially around the outer side 130 of the shielding sleeve 110 in a different way. In particular, it is also possible for the sections of the bead 140 and of the further bead 145 to overlap in the circumferential direction of the shielding sleeve 110, or for the outer side 130 of the shielding sleeve 110 to have angle sections in the circumferential direction, in which angle sections neither sections of the bead 140 nor of the further bead 145 are arranged.

If the shielding sleeve 110 of the first plug connector 100 of the plug connector system 10 is formed as depicted in FIGS. 10 and 11, some of the spring elements 230 of the shielding bushing 210 of the second plug connector 200 come into contact with sections of the bead 140 during the connection of the first plug connector 100 to the second plug connector 200, but, in contrast, other spring elements 230 of the shielding bushing 210 of the second plug connector 200 come into contact with sections of the further bead 145 of the shielding sleeve 110 of the first plug connector 100. During the plugging-together of the first plug connector 100 and the second plug connector 200, the spring elements 230 coming into contact with sections of the bead 140 are deflected earlier than the spring elements 230 coming into contact with sections of the further bead 145. As a result, it is achieved that the forces acting during the plugging-together of the first plug connector 100 and the second plug connector 200 do not depend significantly on the plug-in depth.

Figure 12:
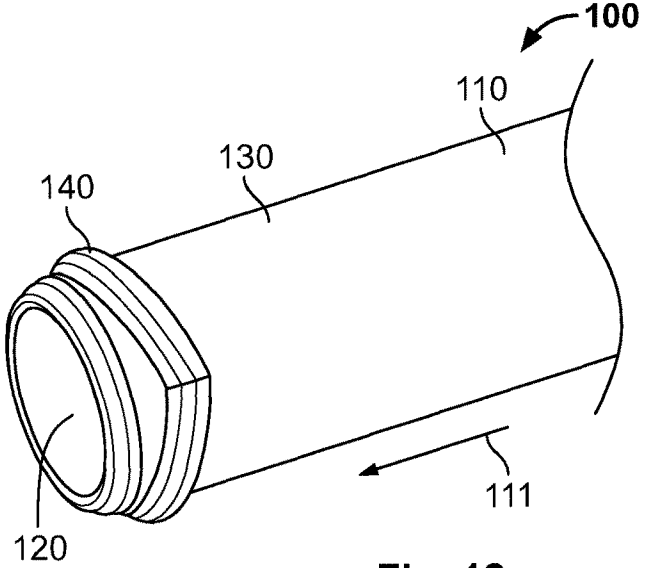
FIG. 12 is a perspective view of the shielding sleeve of the first plug connector according to another embodiment.

FIG. 12 shows a schematic perspective depiction of a further possible design of the shielding sleeve 110 of the first plug connector 100 of the plug connector system 10. In the case of the variant of the shielding sleeve 110 shown in FIG. 12, the bead 140 is formed in a closed, circumferential manner on the outer side 130 of the shielding sleeve 110. However, the bead 140 in this variant is not oriented perpendicularly to the longitudinal direction 111 of the shielding sleeve 110. Instead, the bead 140 is formed in such a way that, in the circumferential direction of the shielding sleeve 110, some sections of the bead 140 are arranged closer to the longitudinal end 120 of the shielding sleeve 110 than other sections of the bead 140.

If the shielding sleeve 110 of the first plug connector 100 of the plug connector system 10 is formed as in the example shown in FIG. 12, some of the spring elements 230 of the shielding bushing 210 of the second plug connector 200 are deflected by the bead 140 of the shielding sleeve 110 of the first plug connector 100 earlier than other spring elements 230 of the shielding bushing 210 during the plugging-together of the first plug connector 100 and the second plug connector 200. As a result, also by way of the configuration of the shielding sleeve 110 shown in FIG. 12, it is achieved that the forces occurring during the plugging-together of the first plug connector 100 and the second plug connector 200 do not change significantly during the plugging-together.

In other embodiments, the described first plug connector 100 can also be connected to plug connectors other than the described second plug connector 200 to form a plug connector system. The described second plug connector 200 can also be connected to plug connectors other than the described first plug connector 100 to form a plug connector system.

In the plug connector system 10, an electrically conductive connection between the shielding sleeve 110 of the first plug connector 100 and the shielding bushing 210 of the second plug connector 200 is produced by the at least partially circumferential bead 140 on the outer side of the shielding sleeve 110 arranged in the shielding bushing 210. As a result, in this plug connector system 10 no spur line arranged inside the shield is formed, in particular no spur line whose dimensions depend on the plug-in depth of the shielding sleeve 110 in the shielding bushing 210. Therefore, this plug connector system 10 can have electrical properties which are simple to manage and independent of tolerances of the plug connectors.

Further, the contact regions of the spring elements 230 are arranged on the inner sides of the spring elements 230 and are protected as a result. The spring elements 230 are formed on the shielding bushing 210 of the second plug connector 200. Because the shielding bushing 210 of the second plug connector 200 receives the shielding sleeve 110 of the first plug connector 100, the shielding bushing 210, for its part, can be arranged in the outer housing 300 of the second plug connector 200. In this case, the spring elements 230 of the shielding bushing 210 are protected from damage.

What is claimed is:

1. A plug connector system, comprising:

a first plug connector having a shielding sleeve, the shielding sleeve having an at least partially circumferential bead on an outer side of the shielding sleeve; and a second plug connector having a shielding bushing with plurality of spring elements, the shielding sleeve is partially received in the shielding bushing and the at least partially circumferential bead contacts the spring elements when the first plug connector is connected to the second plug connector, the second plug connector has an outer housing, the shielding bushing is arranged in the outer housing, the outer housing has a projection on a side of the outer housing facing the shielding bushing.

2. The plug connector system of claim 1, wherein the spring elements are deflectable in a radial direction of the shielding bushing.

3. The plug connector system of claim 2, wherein the spring elements are bent in an unstressed state.

4. The plug connector system of claim 1, wherein the spring elements are a plurality of beams oriented along a longitudinal direction of the shielding bushing.

5. The plug connector system of claim 4, wherein each of the spring elements has a first longitudinal end facing away from an open end of the shielding bushing and a second longitudinal end facing the open end of the shielding bushing.

6. The plug connector system of claim 5, wherein each of the spring elements is clamped at the first longitudinal end.

7. The plug connector system of claim 5, wherein each of the spring elements is clamped at the second longitudinal end.

8. The plug connector system of claim 5, wherein the second longitudinal end of each of the spring elements is free.

9. The plug connector system of claim 8, wherein the shielding bushing has an outwardly bent-over section at the open end.

10. The plug connector system of claim 9, wherein the second longitudinal end of each of the spring elements bears against the outwardly bent-over section.

11. The plug connector system of claim 8, wherein the spring elements are deflected by pushing the shielding sleeve into the shielding bushing, the second longitudinal end of each of the spring elements bears against the outer housing.

12. The plug connector system of claim 11, wherein the second longitudinal end of each of the spring elements bears against the projection of the outer housing.

13. The plug connector system of claim 1, wherein the plug connector system transmits high-frequency signals.

14. The plug connector system of claim 13, wherein the plug connector system transmits high-frequency signals at a specified maximum frequency.

15. The plug connector system of claim 14, wherein a base of the at least partially circumferential bead has a spacing from a longitudinal end of the shielding sleeve.

16. The plug connector system of claim 15, wherein the spacing is less than a fifth of a wavelength of the specified maximum frequency.

17. A first plug connector, comprising:

a shielding sleeve having an at least partially circumferential bead on an outer side of the shielding sleeve, the shielding sleeve is partially received in a shielding bushing of a second plug connector and the at least partially circumferential bead contacts a plurality of spring elements of the second plug connector when the first plug connector is connected to the second plug connector, the first plug connector transmits high-frequency signals at a specified maximum frequency, a base of the at least partially circumferential bead has a spacing from a longitudinal end of the shielding sleeve, the spacing is less than a fifth of a wavelength of the specified maximum frequency.

18. A second plug connector, comprising:

a shielding bushing having a plurality of spring elements, the shielding bushing partially receives a shielding sleeve of a first plug connector and the spring elements contact a bead of the shielding sleeve when the second plug connector is connected to the first plug connector, the spring elements are a plurality of beams oriented along a longitudinal direction of the shielding bushing, each of the spring elements has a first longitudinal end facing away from an open end of the shielding bushing and a second longitudinal end facing the open end of the shielding bushing, each of the spring elements is clamped at the first longitudinal end and clamped at the second longitudinal end.

19. A plug connector system, comprising:

a first plug connector having a shielding sleeve, the shielding sleeve having an at least partially circumferential bead on an outer side of the shielding sleeve; and a second plug connector having a shielding bushing with plurality of spring elements, the shielding sleeve is partially received in the shielding bushing and the at least partially circumferential bead contacts the spring elements when the first plug connector is connected to the second plug connector, the spring elements are a plurality of beams oriented along a longitudinal direction of the shielding bushing, each of the spring elements has a first longitudinal end facing away from an open end of the shielding bushing and a second longitudinal end facing the open end of the shielding bushing, the second longitudinal end of each of the spring elements is free, the shielding bushing has an outwardly bent-over section at the open end, the second longitudinal end of each of the spring elements bears against the outwardly bent-over section.

* * * * *